US008830059B2

(12) United States Patent
Nikolovski

(10) Patent No.: US 8,830,059 B2
(45) Date of Patent: Sep. 9, 2014

(54) FACILITY AND METHOD FOR MONITORING A DEFINED, PREDETERMINED AREA USING AT LEAST ONE ACOUSTIC SENSOR

(75) Inventor: Jean-Pierre Nikolovski, Chatenay-Malabry (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 260 days.

(21) Appl. No.: 13/501,863

(22) PCT Filed: Sep. 30, 2010

(86) PCT No.: PCT/FR2010/052075

§ 371 (c)(1),
(2), (4) Date: Jun. 29, 2012

(87) PCT Pub. No.: WO2011/045500

PCT Pub. Date: Apr. 21, 2011

(65) Prior Publication Data

US 2012/0262294 A1 Oct. 18, 2012

(30) Foreign Application Priority Data

Oct. 13, 2009 (FR) ..... 09 57175

(51) Int. Cl.

| | |
|---|---|
| ***G08B 13/00*** | (2006.01) |
| ***G08B 13/16*** | (2006.01) |
| ***G08B 21/04*** | (2006.01) |
| ***G08B 21/02*** | (2006.01) |

(52) U.S. Cl.

CPC ..... *G08B 21/04* (2013.01); *G08B 13/1672* (2013.01); *G08B 21/02* (2013.01)

USPC ..... 340/565; 340/573.1; 340/539.11; 379/38; 455/404.1

(58) Field of Classification Search

CPC ..... H04W 4/00; G08B 1/00; G08B 21/0469; A61B 2562/024

USPC ..... 340/500, 502, 503, 504, 506, 523, 529, 340/539.1, 539.11, 539.12, 539.13, 565; 379/37, 38, 45; 455/403, 404.1

See application file for complete search history.

(56) References Cited

U.S. PATENT DOCUMENTS 4,829,285 A 5/1989 Brand et al.

(Continued)

FOREIGN PATENT DOCUMENTS

| | | |
|---|---|---|
| EP | 1 872 818 | 1/2008 |
| WO | 99 06979 | 2/1999 |
| WO | 2006 052023 | 5/2006 |

OTHER PUBLICATIONS

International Search Report Issued Feb. 16, 2011 in PCT/FR10/52075 Filed Sep. 30, 2010.

*Primary Examiner* — George Bugg
*Assistant Examiner* — Edny Labbees
(74) *Attorney, Agent, or Firm* — Oblon, Spivak, McClelland, Maier & Neustadt, L.L.P.

(57) ABSTRACT

A monitoring facility includes at least one acoustic sensor arranged in a monitoring area to convert an acoustic wave picked up following the occurrence of an activity in the monitoring area into an information signal, and a processing device to receive the information signal. Also included is a system for transmitting at least one alarm and a database including, for each one of at least one predetermined reference activity, an occurrence of which is likely to generate acoustic waves in the monitoring area, reference characteristics relating to said predetermined reference activity. The processing device includes an analysis system to analyze the information signal according to reference characteristics of at least one predetermined reference activity of the database, and to activate the system for transmitting at least one alarm according to said analysis. Furthermore, at least one acoustic sensor is included to detect seismic waves propagating in a solid medium.

6 Claims, 2 Drawing Sheets

(56) References Cited

U.S. PATENT DOCUMENTS

Figure 1:
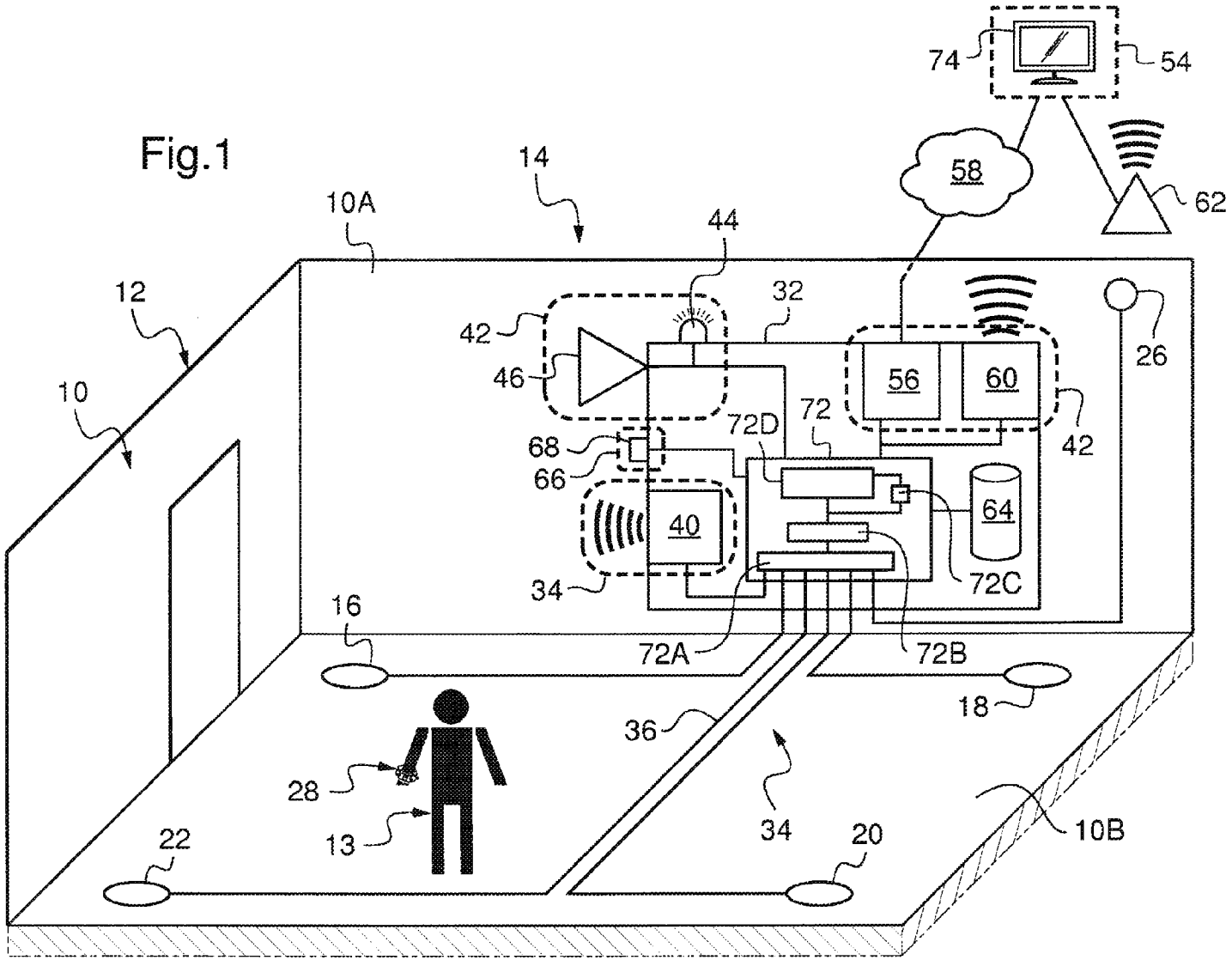

| | | | | |
|---|---|---|---|---|
| 5,568,121 | A * | 10/1996 | Lamensdorf | 340/539.17 |
| 6,288,643 | B1 | 9/2001 | Lerg et al. | |
| 6,313,743 | B1 * | 11/2001 | Abraham-Fuchs et al. | 340/505 |
| 7,145,462 | B2 * | 12/2006 | Dewing et al. | 340/573.1 |
| 7,196,317 | B1 * | 3/2007 | Meissner et al. | 250/227.14 |
| 8,081,082 | B2 * | 12/2011 | Malik et al. | 340/573.1 |
| 2002/0008619 | A1 | 1/2002 | Lerg et al. | |
| 2002/0113702 | A1 | 8/2002 | Pakhomov et al. | |
| 2005/0275541 | A1 * | 12/2005 | Sengupta et al. | 340/573.1 |
| 2006/0176167 | A1 * | 8/2006 | Dohrmann | 340/506 |
| 2010/0016746 | A1 * | 1/2010 | Hampton et al. | 600/523 |
| 2010/0141420 | A1 * | 6/2010 | Acar | 340/506 |

* cited by examiner

FACILITY AND METHOD FOR MONITORING A DEFINED, PREDETERMINED AREA USING AT LEAST ONE ACOUSTIC SENSOR

This invention relates to a facility, a method, and a related computer program for monitoring a predetermined delineated monitoring area.

More specifically, it relates to a monitoring facility comprising:

- at least one acoustic sensor arranged in the monitoring area and designed to convert an acoustic wave picked up following the occurrence of an activity in the monitoring area into an information signal,
- a processing device designed for receiving the information signal, and
- a system for transmitting the information signal to the processing device.

The invention more specifically relates to the monitoring of at least one human activity in the monitoring area.

To protect the safety of a person who is alone and in need of assistance in a predetermined delineated area, such as an elderly and/or disabled person living alone in his or her home, it is important to detect an incident quickly, such as a fall, so that outside help can be provided as soon as possible.

A known solution in the prior art involves equipping the person with a portable device, such as a necklace, having a button or mechanism for calling for help, which, when triggered, sends out an alarm, such as to a monitoring center or to an identified third person. This solution, however, requires an action on the part of the monitored person, which is not always possible, especially in situations involving great distress.

Another, safer solution for the monitored person, is described in the international patent application published under number WO 01/33528. This document refers to a facility for monitoring a predetermined delineated monitoring area comprising:

- one acoustic sensor arranged in the monitoring area and designed to convert an acoustic wave picked up following the occurrence of an activity in the monitoring area into an information signal,
- a processing device designed for receiving the information signal, and
- a system for transmitting the information signal to the processing device.

In this document, the acoustic sensor is a microphone sensor arranged, for example, near the monitored person's bed. The processing device is simply designed to convert the information signal into a sound signal that uses a speaker to reproduce the original sound signal from the picked up acoustic wave. It could be carried, for example, to someone monitoring the person located in the monitoring area. The sound reproduction of all activity in the monitoring area allows the monitor to analyze what is happening. A return path can also allow him or her to reassure the monitored person in real time.

However, this facility has the disadvantage of requiring the continuous attention of the monitor. It leaves open the issue of judging the nature of the sound activity reproduced by the processing device and whether there is a need to render assistance to the monitored person.

It may therefore be desirable to provide a system for monitoring a predetermined monitoring area that can overcome at least some of the above problems and constraints.

The invention therefore relates to a facility for monitoring a predetermined delineated monitoring area, comprising:

- at least one acoustic sensor arranged in the monitoring area and designed to convert an acoustic wave picked up following the occurrence of an activity in the monitoring area into an information signal,
- a processing device designed for receiving the information signal, and
- a system for transmitting the information signal to the processing device, the monitoring facility further comprising:

- a system for transmitting at least one alarm, and
- a database comprising, for each of at least one predetermined reference activity whose occurrence is likely to generate acoustic waves in the monitoring area, reference characteristics relating to said predetermined reference activity, and the processing device including an analysis system designed to:

- analyze the information signal according to the reference characteristics of at least one predetermined reference activity of the database, and
- activate the system for transmitting at least one alarm according to the analysis of the information signal.

Thus, a facility according to the invention provides true assistance to the monitoring person by assisting in the diagnosis of the situation and by interacting directly with an alarm system. Depending on the level of refinement of the analysis, related to the number of reference characteristics and/or predetermined reference activities, it may even be possible to not have a monitoring person.

Advantageously, a monitoring facility according to the invention may comprise, in the monitoring area, at least one acoustic sensor for seismic waves propagating in a solid medium.

Thus, by this use of an acoustic sensor for seismic waves propagating in a solid medium, the monitoring facility according to the invention is highly effective for detecting a fall by a person in the monitoring area. Notably, because this solid medium may comprise the floor of the monitoring area, any information signal provided by the acoustic sensor for seismic waves is then attributable to an activity truly located in the monitoring area.

Furthermore, the seismic waves have the advantage of respecting the privacy of the monitored person. They do not divulge the contents of a conversation, but rather characteristics of footsteps, falls, vibrations, etc. In other words, information contained in a seismic signal is not "sensitive" but "vital". The solid medium in which it propagates serves as a natural filter that selects the right "vital" information to be analyzed by the processing device. Of course, if the acoustic sensor for seismic waves is highly sensitive or if it is a "bi-medium", acoustic signals can also be picked up, but for example only to locate and verify whether they belong to the monitoring area, not to recognize words and sounds.

Optionally, the system for transmitting at least one alarm includes a device, arranged in the monitoring area, for generating a level one alarm.

The monitored person is thus alerted as soon as an unusual situation is detected by the monitoring facility.

Also optionally:

- the system for transmitting at least one alarm further includes a device for generating a level two alarm to outside of the monitoring area, and
- the analysis system is designed to receive an acknowledgment signal and, if no acknowledgment signal is received in a predetermined time period following the generation of the level one alarm, to activate the device for generating the level two alarm.

Also optionally, a monitoring facility according to the invention may further comprise an acknowledgment device arranged in the monitoring area and capable of being activated by a user for generating the acknowledgment signal.

Thus, the monitored person can respond to the generation of the level one alarm by invalidating it if it was a false alarm. If there is no response, the unusual situation is confirmed, which triggers a level two alarm transmitted to somewhere outside of the monitoring area, such as to a monitoring center or to an identified third person.

Also optionally, the analysis system is designed to update the reference characteristics of a predetermined reference activity in the database if an acknowledgment signal is received in the predetermined time period following the generation of the level one alarm.

The system thus refines the database to limit, by learning, the probability of generating level one alarms without good reason.

Also optionally, the analysis system is designed to:

select, from the reference characteristics in the database, a predetermined reference activity from the database that corresponds to the activity, known as the detected activity, from which the information signal results, record a value related to a time when the detected activity occurred and associate this value to the selected reference activity, and determine whether to activate the system for transmitting at least one alarm based on at least this value and the reference activity to which it is associated.

The facility thus detects unusual situations, not only when certain activities that are unusual by nature are detected (falls, cries, etc.), but also based on excessive or insufficient occurrences of normal activities.

Also optionally, the database comprises, for each of a set of predetermined reference activities, reference characteristics related to each predetermined reference activity.

The invention also relates to a method for monitoring a predetermined delineated monitoring area, comprising a step for receiving an information signal obtained from a conversion carried out by an acoustic sensor on an acoustic wave resulting from an occurrence of an activity in the monitoring area, further comprising the following steps:

analyze the information signal from reference characteristics related to at least one predetermined reference activity, and transmit at least one alarm based on this analysis.

Advantageously, a method for monitoring according to the invention can use an acoustic sensor for seismic waves propagating in a solid medium.

Finally, the invention also relates to a computer program that can be downloaded from a communication network and/or saved on a computer-readable medium and/or executed by a processor, comprising computer code instructions for executing the steps of a method for monitoring such as defined above, when said program is executed on a computer.

Figure 2:
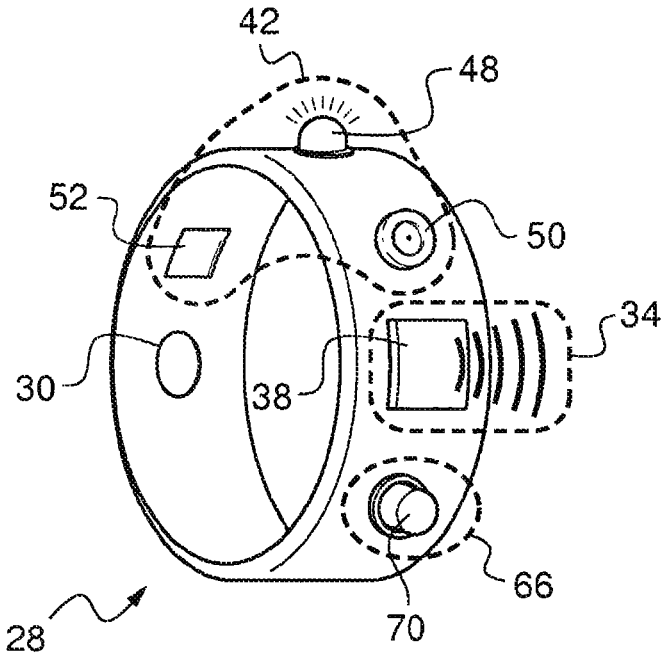
Figure 3:
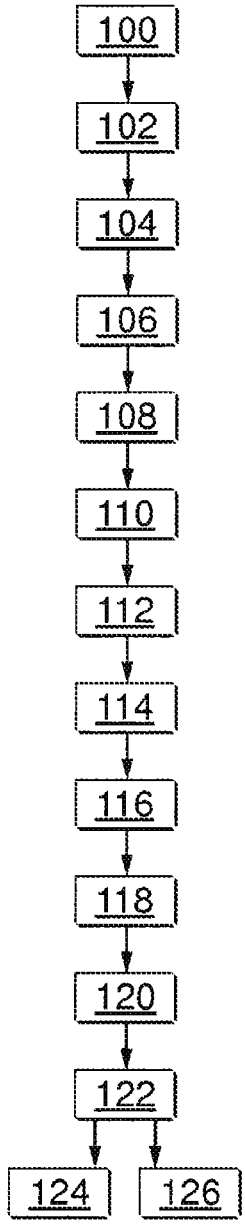

The invention will be better understood using the following description, given purely as reference and referring to the accompanying drawings, in which:

FIG. 1 is a three-dimensional schematic view of a delineated area equipped with a facility for monitoring according to an embodiment of the invention, FIG. 2 is a detailed perspective view of a device, intended to be worn by a person, included in the facility in FIG. 1, FIG. 3 illustrates the successive steps of a method for monitoring implemented by the facility in FIG. 1.

With reference to FIGS. 1 and 2, in the following example of implementing the invention, the monitoring area is made to simplify the illustrations by being a room 10 in an apartment 12, delineated by walls 10A and a floor 10B. A person 13 lives in the apartment 12. He may be an elderly or sick person, who is therefore vulnerable and requires continuous monitoring. With regard to his movements and actions, the person 13 carries out various activities in the apartment 12. Every occurrence of an activity is capable of generating an acoustic wave in the air and/or in solid mediums, specifically the floor 10B and the walls 10A. The acoustic waves are generated either directly by the person 13 (vocal activity, movement in the room 10, voluntary or involuntary knock on the floor 10B and/or the walls 10A, etc.) or indirectly by the use of equipment (movement of chairs, use of household appliances, etc.).

The apartment 12 is equipped with a facility for monitoring 14 intended to use these acoustic waves to detect an emergency situation in the room 10 or more generally a situation requiring intervention.

The facility for monitoring 14 includes a set of acoustic sensors 16, 18, 20, 22, 26, and 30. Each acoustic sensor 16, 18, 20, 22, 26, or 30 is arranged in the room 10 and designed to convert a picked up acoustic wave, resulting from an occurrence of an activity in the room 10, known as a detected activity, into an information signal. Note that, to extend the monitoring to the entire home 12 it would be necessarily to place acoustic sensors in all of its rooms.

In the example illustrated in FIG. 1, the facility for monitoring 14 includes acoustic sensors 16, 18, 20, and 22 for seismic waves. By "seismic waves", this means waves propagating in a solid medium. In the illustrated example, the acoustic sensors 16, 18, 20, and 22 for seismic waves are attached to the floor 10B of the room 10, at fixed and known positions (for example, arranged in a triangle, diamond, or rectangle, as in the illustrated example) and acoustically coupled to the floor 10B. As a result, the solid medium that makes up the floor 10B is an integral part of the monitoring area formed by the room 10. The acoustic sensors 16, 18, 20, and 22 are designed to detect seismic waves propagating in the depth of the floor 10B and/or on its surface. In an alternative that is not illustrated, acoustic sensors for seismic waves could also be attached to the walls 10A.

In general, the size of the monitoring area is defined, partly by the size of the acoustic sensors and their reach and partly by their configuration. This size can be up to several hundred square meters, whether on the ground surface or in a home.

In the illustrated example, the facility for monitoring further includes one acoustic sensor 26 for airwaves (but more may be possible). By "airwaves", this means waves propagating in the air of the room 10. The acoustic sensor 26 for airwaves is attached to one of the walls 10A of the room 10, but it is acoustically coupled to the air in the room 10, so as to serve as a microphone.

Each of the acoustic sensors 16, 18, 20, 22, and 26 for seismic waves and airwaves has a fundamental resonant frequency of between 1 and 10 kHz for use in an apartment, such as 7 kHz.

The monitoring facility 14 further comprises a portable device, like an object 28 worn by the person 13, such as a bracelet. This object 28 further comprises an acoustic sensor 30 for seismic waves designed to detect acoustic waves propagating in the body of the person 13, specifically acoustic waves resulting from heart activity, respiration, or sounds the person 13 emits. This sensor is shown in FIG. 2.

The monitoring facility 14 further comprises a processing device 32 designed to receive each information signal from the acoustic sensors 16, 18, 20, 22, 26, 30 described above. In the example shown, the processing device 32 is included in a box attached to one of the walls 10A of the apartment 12.

The monitoring facility 14 further comprises a system 34 for transmitting, to the processing device 32, information signals from the acoustic sensors 16, 18, 20, 22, 26, 30. In the example shown, the transmission system 34 includes wired connections 36 between the acoustic sensors for seismic waves 16, 18, 20, 22 and airwaves 26, and the processing device 32. In addition, the object 28 and the processing device 32, respectively, are equipped with a wireless communication device 38, 40 so that they can communicate with one another. Therefore, the transmission system 34 also includes these wireless communication devices 38 and 40. The wireless communication devices are, for example, radio wave devices, such as Bluetooth, Zigbee or Wifi devices.

In an alternative that is not illustrated, the transmission system 34 could include wireless communication devices, similar to the devices 38 and 40, to transmit the information signals from the acoustic sensors 16, 18, 20, 22, 26 to the processing device 32.

The facility 14 further comprises a system 42 for transmitting at least one alarm.

In the illustrated example, the system 42 for transmitting at least one alarm includes a device 44, arranged in a fixed manner in the room 10, for generating a level one visual alarm. The level one visual alarm is intended to be able to be seen by the person 13, when said person is in the room 10. The system 42 for transmitting at least one alarm further includes a device 46, arranged in a fixed manner in the room 10, for generating a level one sound alarm. The device 46 may be a speaker, for example. The level one sound alarm is intended to be able to be heard by the person 13, when said person is in the room 10. The devices 44 and 46 for generating a level one alarm are, for example, fixed to the processing device 32.

In the illustrated example, the system 42 for transmitting at least one alarm further includes a mobile device 48 for generating a level one visual alarm, such as an LED, a mobile device 50 for generating a level one sound alarm, such as a piezoelectric beeper (or buzzer), and a mobile device 52 for generating a level one tactile alarm, such as a vibrator produced using a small unbalanced motor. The devices 48, 50, 52 are attached to the object 28 in order to track the person 15 in his movements.

Of course, in an alternative that is not illustrated, the system 42 for transmitting at least one alarm could include only one device for generating a level one alarm. Level one alarms are intended to alert the person 13 that an unusual situation was detected by the monitoring facility 14 and thus providing the opportunity to invalidate said detection by responding using an acknowledgment message, as will be explained later.

The monitoring facility 14 may further include a remote monitoring center 54 or be part of such a monitoring center 54 when it is intended, for example, to monitor multiple monitoring facilities. The monitoring center 54 is connected to a data transmission network 58, such as the Internet, and also to a wireless telecommunication network, such as a telephone network.

In order to alert the remote monitoring center 54 of a confirmed unusual situation, if there is no acknowledgment on the part of the person 13 following the transmission of a level one alarm (as will be explained later), the system 42 for transmitting at least one alarm includes a first device 56 for generating a level two alarm designed to send a level two alert message to the remote monitoring center 54, via the Internet 58. The level two alarm may include, for example, an email message. The system 42 for transmitting at least one alarm further include a second device 60 for generating another level two alarm to the remote monitoring center 54, via the wireless network 62. This other level two alarm may include, for example, an SMS or a conventional phone call. In the example shown, the two devices 56, 60 are included in the processing device 32.

Note that, for the two devices 56, 60, the level two alarm is generated to outside of the monitoring area.

In order to be able to detect an unusual situation, the monitoring facility 14 further includes a database 64 comprising, for each of at least one predetermined reference activity whose occurrence is likely to generate acoustic waves in the room 10, reference characteristics relating to said predetermined reference activity. Preferably, the database 64 contains reference characteristics for a set of reference activities. In the example shown, the database 64 is located in the processing device 32.

The reference characteristics are intended to allow the reference activities to be distinguishable from one another and to determine whether a situation is unusual in the room 10 based on a repetition (or lack of repetition) of one or more activities that are produced in the room 10, from the predetermined reference activities.

Thus, the reference characteristics for each reference activity first include reference characteristics relative to the information signals themselves. In the example shown, these reference characteristics include a reference information signal that is representative of the corresponding reference activity. Therefore, the database 64 associates the "steps in the room" event to a previously recorded footstep reference information signal, for example. In an alternative that is not described, it is possible to have a specific reference information signal for each acoustic propagation medium, including a solid, air, etc.

Moreover, the reference characteristics for each reference activity include reference characteristics relating to the repetition in the time of that reference activity. For example, these reference characteristics include a data item representing an interval of time deemed normal between two occurrences of the considered reference activity and a data item represent a threshold time interval between two successive occurrences, beyond which the repetition of the considered activity is deemed unusual, which may indicate a problem for the person 13.

The reference characteristics may, for example, include (the first data item between parentheses represents the normal repetition time interval, and the second data item between parenthesis represents the threshold repetition time interval):

- footsteps, shuffling of slippers (3 hours, 24 hours),
- operation of physical exercise machines, such as a stationary bike, treadmill, or some other machine (24 hours, never),
- small impact characteristics of a meal (utensils on a plate, metal on ceramic) (4 hours, 24 hours),
- opening a bottle of wine (1 week, never),
- flow of water from a faucet (3 hours, 12 hours),
- shower (24 hours, 72 hours),
- flushing (4 hours, 12 hours),
- sound of dishes (4 hours, 24 hours),
- use of a bathroom (4 hours, 24 hours),
- use of a broom, vacuum cleaner (24 hours, one week),
- opening/closing an apartment door (12 hours, 24 hours),
- use of keys in a lock (4 hours, 12 hours),
- opening/closing of a refrigerator door (4 hours, 24 hours),
- opening/closing of drawer, an armoire door, a cupboard (12 hours, 48 hours),
- handling of a chair (2 hours, 24 hours),
- audible timer from a microwave oven (12 hours, 24 hours),
- operation of a coffee maker (12 hours, never), ringing of a telephone (24 hours, never),
sound of conversations (3 hours, 24 hours),
songs (24 hours, never),
calls (24 hours, never),
use of musical instruments (24 hours, never),
tears (rare, never),
laughter (24 hours, never),
cries (rare, never),
breathing (2 seconds, 5 seconds),
snoring (24 hours, never),
flatulence (24 hours, 48 hours),
falling objects (12 hours, 48 hours),
television (12 hours, 24 hours),
radio and/or stereo (12 hours, 24 hours),
etc.

In the non-exhaustive illustrative list above, the value "rare" can be associated with a predetermined interval of several days, several weeks, or several months, depending on the person 13. The value "never" means that the corresponding interval is infinite. If it is associated with a threshold interval, this means that there is no threshold value beyond which the considered activity must be considered to be unusual.

Alternatively, the reference characteristics relative to the repetition over time of a reference activity may be more complex. For example, these reference characteristics may include a probability for the expected time interval between two occurrences. In this case, the probability is preferably centered on the normal time interval and decreases on either side of this normal time interval. Also in this case, a difference between two occurrences of the reference is, for example, considered to be unusual when its probability is located more than two standard deviations from the normal time interval.

In order to allow the person 13 to invalidate a level one alarm, the monitoring facility 14 includes an acknowledgment system 66 designed to generate an acknowledgment signal in response to an acknowledgment action on the part of the person 13. In the example shown, the acknowledgment system includes a fixed acknowledgment device 68, fixed to the processing device 32, and a mobile acknowledgment device 70, worn by the object 28. The acknowledgment devices 68, 70 are, for example, push buttons.

The processing device 32 further includes an analysis system 72. In the example shown, it is an electronic circuit board with automatic gain control and signal processing.

The analysis system 72 thus includes a multiplexer 72A that can selectively receive the information signal coming from each acoustic sensor 16, 18, 20, 22, 26, 30.

The analysis system 72 further includes a broadband amplifier stage 72B, such as from 0 to 100 kHz, whose gain is digitally programmable.

The analysis system 72 further includes a filter 72C that receives the amplified information signal and is designed to locate, in the room 10, an activity detected by the acoustic sensors 16, 18, 20, 22. Preferably, the location is carried out by a differential transit time measurement between at least three separate acoustic sensors. The filter 72C is further designed, if fewer than three sensors only detect the acoustic waves resulting from an activity detected in a time interval of less than 20 ms (to allow the detection of 50 Hz sounds), such as 15 ms, to categorize the event as a parasitic (non-acoustic) electrical signal.

The analysis system 72 further includes a microcontroller unit (or MCU) 72D that receives the amplified information signals and is capable of converting them by embedded analog/digital converters. A computer program in the microcontroller unit 72D is responsible for carrying out the detailed functions below, which are also functions of the analysis system 72.

The microcontroller unit 72D is thus designed to automatically control the gain of the amplifier stage 72A so that the information signals are amplified up to a self-triggering threshold corresponding to a situation in which the signal-to-noise ratio is considered to be too degraded. The sensitivity level of each of the sensors is thus variable in stages, such as a range of 16 stages, over time while remaining at one or two stages below a predetermined number of false alarms, such as fewer than 50 false alarms per second.

The microcontroller unit 72D is further designed to compare the intensity of each amplified information signal at a predetermined threshold level, indicating, when surpassed, that the corresponding acoustic sensor is picking up acoustic waves resulting from an activity, known as a detected activity, in the room 10.

If the activity detected by the acoustic sensors 16, 18, 20, 22, 26, 30 was not categorized as a parasitic activity, the microcontroller unit 72D is designed to record the information signal from at least one of the acoustic sensors that picked up the acoustic waves resulting from a detected activity. Preferably, the information signals are recorded for a maximum of five seconds in order to protect the privacy of the person 13.

The microcontroller unit 72D is also designed to analyze the recorded information signal(s), based on reference characteristics for at least one of the reference activities in the database 64. More specifically, the microcontroller unit 72D is designed to look up the reference characteristics for reference information signals in order to determine, based on these reference characteristics, a predetermined reference activity from the database 64 that corresponds to the detected activity. In the example shown, the microcontroller unit 72D is designed to correlate each recorded information signal with the reference information signals in order to identify the detected activity as corresponding to the most strongly correlated reference activity.

Some of the reference activities may be deemed critical (such as a cry from the person 13). In this case, if the detected activity corresponds to one of these reference activities, the microcontroller unit 72D is designed to activate at least one of the devices for generating a level one alarm 44, 46, 48, 50, 52, in order to notify the person 13 that an unusual situation was detected by the monitoring facility 14.

The microcontroller unit 72D is further designed to accurately timestamp the occurrence of the reference activity corresponding to the detected activity and to record this occurrence time. As mentioned above with the definition of reference characteristics relating to the repetition of each reference activity over time, this makes it possible, for example, to detect an unusual situation based on an unusual frequency of detected occurrences of the considered reference activity.

But note that the act of timestamping the occurrence of an activity can also have an impact on monitoring other reference activities in the database. Such an occurrence indicates, for example, that the person being monitored 13 is still in the monitoring area, so we update the tracking of other activities and not just that of the reference activity under consideration.

The microcontroller unit 72D is further designed to estimate, at a given moment, the interval of time that has passed since said given moment and the time of the last recorded occurrence of each reference activity. In the described example, the estimated time interval for a given activity is compared to the threshold repetition time interval for that activity. This estimate makes it possible to determine which reference activity (or activities) has an unusual repetition.

Preferably, the microcontroller unit 72D is designed to carry out this estimate at a regular interval. Preferably, this regular interval is shorter when an activity is being detected by the acoustic sensors, such as one second instead of five seconds when no activity is detected.

The microcontroller unit 72D is further designed to activate the system 42 for transmitting at least one alarm based on this estimate of elapsed time from the last occurrence of each reference activity. More specifically, the microcontroller unit 72D is programmed to activate the system 42 for transmitting at least one alarm based on reference activities whose repetition is deemed to be unusual, based on a system of rules following, for example, a law of probability that a situation is unusual based on unusual repetitions of one or more activities.

In the example shown, the microcontroller unit 72D is designed to activate at least one of the devices for generating a level one alarm 44, 46, 48, 50, 52, in order to notify the person 13 that an unusual situation was detected by the monitoring facility 14.

The microcontroller unit 72D is further designed to receive an acknowledgment signal from the person 13 and, if no acknowledgment signal is received during a predetermined time period (such as one minute) after the generation of a level one alarm, to activate at least one of the devices for generating a level two alarm 56, 60.

In the example shown, the acknowledgment signal is either the signal generated by the acknowledgment system 66 or a specific reference activity (such as clapping hands) carried out by the person 13 in the room 10 and detected by the monitoring facility 14 in the previously described manner.

If an acknowledgment signal is received during the predetermined time period following the generation of a level one alarm, the microcontroller unit 72D is designed to update the reference characteristics of at least one of the reference activities in the database 64. Preferably, the microcontroller unit 72D is designed to update the reference characteristics of the reference activities whose repetition was detected as being unusual and triggered the level one alarm. This update is intended to adapt the database 64 to the life rhythm of the person 15. Preferably, the threshold repetition time intervals are initialized at low values or adjusted later by a questionnaire completed upfront by the person subscribing to the monitoring service regarding his or her habits in order to reduce the number of level one alarms generated at the start of service. In this case, the update to the reference characteristics for a reference activity includes increasing the threshold time interval between two occurrences of this reference activity.

Furthermore, preferably, the remote monitoring center 54 includes a display device 74 of the layout of the room 10 (or more generally the home of the person 13). The display device 74 is then designed to display, upon request, the position on this layout of the most recent occurrences of reference activities detected in the room. The display device is further designed to display a list of the most recent occurrence of reference activities detected in the monitoring area.

With reference to FIG. 3, a monitoring method implemented by the monitoring facility in FIG. 1 will now be described.

The acoustic sensors continuously generate the information signals that are transmitted to the processing device 32 by the transmission means 34.

During a step 100, an activity is produced in the room 10, such as the person 13 moving by walking, leading to footstep impacts on the floor. The activity generates acoustic waves in the room 10 that are propagated in the air and/or in the floor.

During a step 102, at least one of the acoustic sensors 16, 18, 20, 22, 26, 30 picks up an acoustic wave generated by the produced activity and converts it into an information signal.

During a step 104, the information signal resulting from the picked up acoustic wave is transmitted by means of the transmission system 34 and is received, during a step 106, by the analysis system 72.

Then, during a step 108, the microcontroller unit 72D compares the intensity of each (amplified) information signal at a predetermined threshold level and determines which acoustic sensor(s) is currently picking up acoustic waves resulting from an activity, known as a detected activity, in the room 10.

Then, during a step 110, the microcontroller unit 72D records the information signal from at least one of the acoustic sensors picking up acoustic waves resulting from the detected activity.

During a step 112, the microcontroller unit 72D analyzes the recorded information signal(s), using the reference characteristics of at least one of the reference activities in the database 64, and determines the reference activity corresponding to the detected activity. In this current example, it is the sound of footsteps.

Since this activity is not considered to be critical, the microcontroller unit 72D does not yet activate the devices for generating a level one alarm.

During a step 114, the microcontroller unit 72D timestamps the occurrence of the reference activity corresponding to the detected activity and records the time of occurrence of that reference activity.

During a step 116, repeated periodically, the microcontroller unit 72D estimates the time that has elapsed since the time of the last recorded occurrence of each reference activity. From the reference characteristics related to the normal or limit occurrences of reference activities, the microcontroller unit 72D determines which reference activity or activities has (have) an unusual repetition.

If, during the step 116, at least one reference activity is detected as having an unusual repetition, then during the next step 118, the microcontroller unit 72D activates at least one of the devices for generating a level one alarm 44, 46, 48, 50, 52.

Then, during a step 120, the person 13 eventually responds to the level one alarm by sending an acknowledgment signal either by using the acknowledgment system 66 or by carrying out the previously mentioned acknowledgment reference activity.

The step 120 is followed by a step 122, during which the microcontroller unit 72D waits for the acknowledgment signal.

If no acknowledgment signal is received during a predetermined time period (such as one minute) following the generation of a level one alarm (step 118), the microcontroller unit 72D activates, during a step 124, at least one of the devices for generating a level two alarm 56, 60.

If the acknowledgment signal is received during the predetermined time period following the generation of a level one alarm, the microcontroller unit 72D updates during a step 126 the reference characteristics of at least one of the reference activities in the database 64 (in our example, it updates the sound of footsteps activity).

It is clear that the invention makes it possible to identify an unusual situation or recognize a distress signal coming from people living alone or in isolation in an apartment, building, or more generally a delineated monitoring area. Specifically, the monitoring facility in the invention is highly effective for detecting a fall by a person in the monitoring area, by the use of acoustic sensors, specifically acoustic sensors for seismic waves.

Also note that the invention is not limited to the embodiment described previously. As is known to those skilled in the art, there are various modifications that can be made to the embodiment described above, with respect to the instruction that has been disclosed. In the following claims, the terms used should not be interpreted as limiting the claims to the embodiment presented in this description, but should be interpreted to include all of the equivalents that the claims intend to cover by their formulation and whose projection is within reach of those skilled in the art by applying their general knowledge to the instruction that has just been disclosed.

Specifically, the acoustic sensors can be adapted to any physical medium that propagates waves, whether it is a solid, liquid, or gas (air) medium.

Also specifically, the processing device 32 is not necessarily arranged in the monitoring area. It can be mounted remotely, such as in a monitoring center for multiple monitoring areas.

The invention claimed is:

1. A facility for monitoring a predetermined delineated monitoring area, comprising:

at least one acoustic sensor arranged in the monitoring area and configured to convert an acoustic wave picked up following the occurrence of an activity in the monitoring area into an information signal;

a processing device configured to receive the information signal;

a system to transmit the information signal to the processing device;

a system to transmit at least one alarm; and a database comprising, for each of at least one predetermined reference activity whose occurrence is likely to generate acoustic waves in the monitoring area, reference characteristics relating to said predetermined reference activity, wherein the processing device includes an analysis system configured to:

analyze the information signal according to the reference characteristics of at least one predetermined reference activity of the database, and activate the system to transmit at least one alarm according to the analysis of the information signal, the monitoring area includes the at least one acoustic sensor detecting seismic waves propagating in a solid medium, the system to transmit at least one alarm includes a device, arranged in the monitoring area, to generate a level one alarm and a device to generate, to outside of the monitoring area, a level two alarm, and the analysis system is configured to receive an acknowledgment signal from a user and to:

activate the device to generate the level two alarm when no acknowledgment signal is received in a predetermined time period following the generation of the level one alarm, and update the reference characteristics of a predetermined reference activity in the database when an acknowledgment signal is received in said predetermined time period following the generation of the level one alarm.

2. The monitoring facility according to claim 1, further comprising:

an acknowledgement device arranged in the monitoring area and configured to be activated by the user to generate the acknowledgment signal.

3. The monitoring installation according to claim 1, wherein the analysis system is configured to:

select, from the reference characteristics in the database, a predetermined reference activity from the database that corresponds to the activity, known as the detected activity, from which the information signal results, record a value related to a time when the detected activity occurred and associate this value to the selected reference activity, and determine whether to activate the system to transmit at least one alarm based on at least this value and the reference activity to which it is associated.

4. The monitoring facility according to claim 1, wherein the database comprises, for each of a set of predetermined reference activities, reference characteristics relating to each predetermined reference activity.

5. A method for monitoring a predetermined delineated monitoring area, comprising:

receiving an information signal obtained from a conversion carried out by an acoustic sensor for an acoustic wave resulting from an occurrence of an activity in the monitoring area;

analyzing the information signal from reference characteristics related to at least one predetermined reference activity; and transmitting at least one alarm based on this analysis, wherein the sensor is an acoustic sensor for seismic waved propagating in a solid medium and the transmitting at least one alarm includes the generation of a level one alarm, and the generation of a level two alarm when no acknowledgment signal is received in a predetermined time period following the generation of the level one alarm, and an update to the reference characteristics of at least one predetermined reference activity when an acknowledgment signal is received in said predetermined time period following the generation of the level one alarm.

6. A nontransitory computer-readable medium storing a computer program comprising instructions to execute the method for monitoring according to claim 5, when said computer program is executed on a computer by a processor.

* * * * *